United States Patent [19]

Rainer et al.

[11] 4,034,764

[45] July 12, 1977

[54] SMOKING MATERIAL AND METHOD FOR ITS PREPARATION

[75] Inventors: Norman B. Rainer; Charles B. Hoelzel; William C. Hopkins, all of Richmond, Va.

[73] Assignee: Philip Morris Incorporated, New York, N.Y.

[21] Appl. No.: 604,944

[22] Filed: Aug. 15, 1975

[51] Int. Cl.[2] ..... A24B 15/00; A24D 1/18

[52] U.S. Cl. ..... 131/2; 131/15 R; 131/15 C; 131/17 R; 536/1; 536/2; 536/3; 536/56; 536/63; 536/102

[58] Field of Search ..... 131/2, 15 C, 15 R, 17 R; 260/209.5, 209 R, 209.6, 233.3 R, 209 D, 224, 212, 234 R; 252/186

[56] References Cited

U.S. PATENT DOCUMENTS

| | | | |
|---|---|---|---|
| 1,760,042 | 5/1930 | Crespi et al. | 8/DIG. 21 |
| 1,957,937 | 5/1934 | Campbell et al. | 8/DIG. 21 |
| 2,232,990 | 2/1941 | Yackel et al. | 131/2 |
| 2,438,100 | 3/1948 | Whitner | 8/DIG. 21 |
| 3,459,195 | 8/1969 | Silberman | 131/2 |
| 3,478,752 | 11/1969 | Briskin et al. | 131/2 |
| 3,516,416 | 6/1970 | Briskin et al. | 131/2 |
| 3,545,448 | 12/1970 | Morman et al. | 131/2 |
| 3,577,994 | 5/1971 | Keller et al. | 131/2 |
| 3,720,660 | 3/1973 | Arendt et al. | 131/2 |
| 3,897,792 | 8/1975 | Yasui et al. | 131/2 |

FOREIGN PATENT DOCUMENTS

| | | | |
|---|---|---|---|
| 727,771 | 4/1955 | United Kingdom | 8/DIG. 21 |

OTHER PUBLICATIONS

"Chemistry and Technology of Citrus, Citrus Products and Byproducts," Agr. Hdbk., No. 98, U.S. Dept. Agr., Wash. D.C., pp. 18–20, 53–56, (1956).

*Primary Examiner*—Robert W. Michell
*Assistant Examiner*—T. S. Gron

[57] ABSTRACT

An improved smoking material is provided by the treatment of a film-forming carbohydrate material with ozone. In accordance with the present disclosure, a film-forming carbohydrate material, for example, polysaccharide is contacted, under controlled conditions, with gaseous ozone and is formed into a smoking product. During the ozone treatment, the carbohydrate material may be in particulate or other solid form or may be dissolved or dispersed in a suitable liquid medium, such as water. The ozone-treated film-forming carbohydrate material may be cast, by known methods, on a drying surface to form a solid film. The resulting film may then be cut or comminuted for use as a tobacco substitute or as a tobacco supplement in a smoking article. Such films may also be used as wrappers for smoking compositions.

9 Claims, No Drawings

SMOKING MATERIAL AND METHOD FOR ITS PREPARATION

BACKGROUND OF THE INVENTION

It has been a goal, in the field of smoking articles, to provide a tobacco substitute which would possess those properties which are most desired in tobacco and which would have none of those properties which are least desired in tobacco.

In attempts to discover or develop a satisfying and pleasant tobacco substitute, numerous materials have been investigated for possible utilization as a substitute for all or part of the tobacco customarily used in smoking products. Some of the materials which have been investigated include, for example, paper pulp, as described in Osborne, U.S. Pat. No. 3,125,098, waste beet pulp, as described in Hind et al, U.S. Pat. No. 3,703,177, carbon or graphite fibers, mat or cloth, as described in Bennett, U.S. Pat. No. 3,738,374, and coffee bean hulls, as described in Deszyck, U.S. Pat. No. 3,796,222. However, time and experience have shown that discovery or development of a fully satisfactory, economically feasible tobacco substitute has been an elusive, and yet to be attained, objective. The subtleties of smoking and the intricate nature of producing a product which will be pleasing to the discerning smoker, from viewpoints of taste, flavor, aroma and other aspects of tobacco desired by such an individual, make discovery or development of a satisfactory tobacoo substitute extremely difficult. Hence, while numerous attempts have been made to prepare a tobacco substitute, including many attempts made during wartime and inflationary periods when obtaining tobacco was difficult and expensive, none has resulted in the discovery or development of a fully satisfactory product.

Of the many materials investigated for use as tobacco substitutes, carbohydrates of naturally occurring origin, such as sugars, starches and celluloses, have been tried because of their ready availability, good burning characteristics, and low cost. For example, such materials are described in Osborne, U.S. Pat. No. 3,125,098; Hind et al, U.S. Pat. No. 3,529,602; and Bennett, U.S. Pat. No. 3,738,374. However, the carbohydrates tested in smoking articles have generally been found to provide a smoke which is not as pleasant as that of tobacco, having a taste which is harsher and more pungent that that of most tobaccos. This undesirable feature has been particularly associated with the sidestream smoke which occurs between puffs of the smoking article. Certain carbohydrate materials have also been found to be difficult or impossible to use as tobacco substitutes or as wrapper materials due to their inability to survive the required handling and shaping called for in the fabrication process. In order to be used as a wrapper in a smoking article, it has generally been necessary for a smoking material to be capable of being processed into a uniform, paper-like sheet without having any hard, splinty areas, and to have adequate resiliency and strength to enable its wrinkle-free application to smoking articles in such a manner that it will not tear due to vigorous digital or oral manipulation. In order for materials to be used as filler in a smoking article, it has generally been necessary for them to possess the capability of being shaped into elongated ribbon or shred-like forms having sufficient strength to withstand handling without breaking down into fine particles or dust.

Attempts have been made to convert carbohydrate materials of the type described above to more desirable forms. For example, a tobacco substitute material has been prepared by heating wood to high temperatures in the absence of air to convert the wood to a charcoal, which may then be combined with flavoring materials to produce a smoking product, as is set forth in Siegel, U.S. Pat. No. 2,907,686. In another process, a tobacoo replacement material has been prepared by the catalytic degradation of carbohydrate materials at temperatures between 100° and 250°C., as is set forth in Morman et al, U.S. Pat. No. 3,545,448. In still another process, a smoking material is formed by the thermal reaction of a cellulosic material in the form of a fibrous carbohydrate at a temperature of about 275° to 375° C. in a non-oxidizing atmosphere, as is set forth in Briskin, U.S. Pat. No. 3,861,401. In still another process, a smoking product is prepared by oxidizing cellulose and adding certain mineral ingredients to the same, as is set forth in Briskin, U.S. Pat. No. 3,447,539. However, none of these processes has resulted in a product which is completely satisfactory.

SUMMARY OF THE INVENTION

This invention relates to improvements in the subjectively perceived smoking qualities of certain naturally occurring materials to be used as tobacco substitutes. More particularly, the invention relates to a novel smoking material consisting of a film-forming carbohydrate material, and particularly a polysaccharide, which has been treated with ozone to improve its smoking characteristics, and to a novel process for making such a smokng material. The smoking material of this invention can be used as filler of as wrapper in a smoking article and has been found to provide acceptable smoking characteristics.

The ozone-treated carbohydrate material of this invention can be incorporated into cigarettes, cigars, cigarillos, pipe tobacco and other smoking products, either as the sole smoking ingredient in place of tobacco or as a partial replacement for it. The ozone-treated carbohydrate material may also be utilized as a wrapper for smoking articles; however, it has generally been found to be most useful, in the form of shreds or shredded film, as a filler in smoking articles.

A preferred embodiment of the process of the present invention involves the steps of (1) contacting a film-forming carbohydrate with ozone gas under controlled conditions, (2) combining the ozone-treated carbohydrate with a casting fluid, (3) casting the resulting mixture on a drying surface to form a thin layer, (4) drying said layer into a solid film, and (5) cutting or comminuting the film for use as a substitute in a tobacco product.

Another embodiment of the process of the present invention involves the steps of (1) forming a film of the carbohydrate material and (2) thereafter treating the film, as a film or in shredded or comminuted form, with ozone gas under controlled conditions.

DESCRIPTION OF THE INVENTION

In the practice of one form of the invention, a film-forming carbohydrate material is treated by, first, contacting it with ozone, generally as a component of a gaseous mixture. Next, the ozone-treated carbohydrate is dissolved or dispersed in a casting fluid, preferably an aqueous liquid. The liquid dispersion or solution of ozone-treated carbohydrate is then cast by conventional means as a thin layer onto a drying surface. The layer is, thereafter, heated and dried to form a solid film, which may then be cut or comminuted into a form suitable for use as a substitute in a tobacco smoking product.

Film-forming carbohydrates which may be employed in accordance with the present invention include carbohydrates, particularly polysaccharides, capable of forming films and carbohydrates, particularly polysaccharides, which are components of naturally occurring materials capable of forming films.

Polysaccharides which may be employed in accordance with the present invention may be characterized by the formula:

$$C_x(H_2O)_{x-1}$$

wherein $x$ has a value of at least 19 and will generally be from 600 to 12,000, and preferably is from 1,200 to 6,000.

Preferred polysaccharides may be characterized by the formula:

$$(C_6H_{10}O_5)_n$$

wherein $n$ may have a value of from 100 to 2,000.

Other carbohydrate materials which may be employed may be characterized by the following formulas:

(I) $(C_6H_8O_6)_n$, polygalacturonic acid (II) $(C_7H_{10}O_5)_n$, pectin (as methyl ester)

wherein $n$ may have a value of from 100 to 2,000.

The carbohydrates which may be employed can be decomposed by hydrolysis into molecules of monosaccharide. Polysaccharides which are particularly useful, in accordance with the present invention, are naturally occurring polymers which may be considered as derived from monosaccharide aldose or ketose units by condensation polymerization. The aldose and ketose units are held together by glycoside oxygen linkages which, upon hydrolysis, produce monosaccharides which, upon further hydrolysis, form hydroxyaldehydes or hydroxyketones. Different polysaccarides may differ with respect to the type of monosaccharide units, polymer chain length, chain linearity or branching, and with respect to other properties. The preferred species of polysaccharides are ones with relatively high molecular weight which may be considered polymers consisting of recurring gluco or fructopyranose ring units or mixtures thereof. Also, these preferred species are ones which have a sufficiently high molecular weight to form films of useful strength when cast from a carrier liquid. Furthermore, the preferred species of polysaccharides should be either water soluble or dispersible, or should be a material which will be water soluble or dispersible after the ozone treatment of this invention.

Typical classes of suitable polysaccharides which may be employed in accordance with the present invention are amylose, amylopectin, polyuronic acid and its salts, algins, starches, glycogen, xylan, dextrins, agar, araban, mannan, and gums of vegetable origin such as arabic, tragacanth, karaya, locust bean and guar. Other classes of suitable polysaccharides include inulin (which has a beta-fructo-pyranose ring structure), cellulose and cellulose esters, hemicelluloses, such as mannan, agar-agar, xylan, pectins and chitin. In addition, elementary derivatives of naturally occurring polysaccharides are suitable for utilization in this invention. Such derivatives include those wherein a portion of the alcohol groups of the polysacchardie has been converted to ether, acetal or ester groups; or oxidized to ketones, aldehydes or carboxylic acids; and derivatives formed by neutralizing carboxyl groups, saponifying ester or ether groups, or producing chain cleavage by hydrolytic degradation. Although such polysaccharide derivatives will no longer have the empirical formulas indicated above, preferred species will still contain glucopyranose rings interconnected by glycoside oxygen linkages.

In addition, the polysaccharides which may be used in this invention may be either in pure form or admixed with polysaccharide-containing substances. For example, suitable materials of natural origin which contain significant amounts of useful polysaccharide material include; citrus fruit rinds, such as lemon albedo, apple pomace, seaweed, tomato pomace, and various starch-containing materials.

The film-forming carbohydrate materials may also be a natural polyuronide film-forming material, for example, a pectin or an algin or mixtures of the same or may be a natural galactomannan film-forming material, for example, locust bean gum or guar gum. Other natural polysaccharides which will form satisfactory films include gum karaya, gum acacia, British gum, agar, starch, carib gum, carrageenin and xanthan. For some applications, the film-forming ingredient may be a pectinaceous material or guar gum or a mixture of these materials. Some of the natural polysaccharide film-forming materials which may be employed in the present invention, for example, to form a wrapper composition, are hydrolyzed guar gum, locust bean gum and alginates which, while slightly less preferred than pectin or guar gum, have also been found to provide relatively low levels of pyrolysis flavor. The polysaccharide material, for example, the pectinaceous material and/or guar gum, may be employed as the sole film-forming ingredient or may be combined with other film-forming ingredients, as will be described later in this specification. These materials perform extremely well, in accordance with the present invention and contribute a very low level of flavor to the smoke, when burned. These materials may be obtained from conventional commercial sources or may be prepared by known methods. The pectins may be fruit pectins or vegetable pectins and may be employed as a commercial pecting extracted from a fruit or vegetable or as a pectin-containing fruit component, such as lemon albedo. Pectins having various degrees of methylation may also be employed.

Various other natural polysaccharide film-forming ingredients which contribute low levels of flavor upon pyrolysis may be employed. The natural polyuronide film-forming materials, including the pectins and algins, and the natural galactomannan film-forming materials, including locust bean gum and guar gum, are castable from a water solution or suspension, and most of these are water soluble.

For convenience, since most of the film-forming carbohydrate materials employed in accordance with the present invention will be classified as polysaccharides, the term polysaccharides will be used in the discussion which follows. It should be understood, however, that other film-forming carbohydrates, which might not be characterized as polysaccharides, may also be employed in accordance with the present invention, provided they have the characteristics set forth in this specification.

The essence of the present invention resides in the treatment of such film-forming materials, whether the materials are known as smoking materials or not, with ozone to provide an improved material for use in a smoking article, such as a cigarette, as filler and/or as wrapper.

After the polysaccharide or polysaccharide-containing material has been collected, it may then be prepared for treatment with ozone. The polysaccharide which, of course, may comprise a single polysaccharide or a mixture of more than one polysaccharide, is preferably treated while in solid form and, more preferably, in a finely comminuted or porous form in order to expose the greatest amount of surface area to contact with ozone.

After the polysaccharide has been comminuted, it may be placed in a container or reactor. The moisture content of the polysaccharide should be at a level of from about 5 per cent to about 80 per cent by weight, based on the total weight of the moisture-containing polysaccharide, and is preferably from about 10 per cent to about 35 per cent. If necessary, an adjustment is made to the moisture content of the polysaccharide to bring it to the desired level. If the initial moisture content of the polysaccharide is above, or below, the preferred range then drying, for example, by heating, or wetting, for example, by steaming or atomizing, respectively, would be required to adjust to the proper level. Such a moisture adjustment may be made over a period from a few seconds to 24 hours, with temperature and pressure conditions suitable to the processor, although ordinary ambient room temperature and atmospheric pressure are satisfactory. The polysaccharide may be allowed to equilibrate in the container to bring the moisture content of the material in the entire container uniformly within the preferred range. This equilbration will depend upon the working and desired parameters of the moisturizing operation, namely, the initial moisture content of the polysaccharide, the precise amount of moisture necessary to bring the final content within the desired range, and the type of operation to be used, whether heating, steaming or atomizing, or whether continuous or batch treating.

The container in which the polysaccharide is placed for moisture processing, and possibly for subsequent steps in the treatment method of this invention, is preferably a fixed tower. However, the container may also be of any other shaped and mobility design, as long as complete contacting of the solid material by the gaseous mixture may be effected. For example, the polysaccharide undergoing treatment may be maintained within a rotating drum or tube, through which the ozone-containing gas is passed.

The polysaccharide is preferably packed in the container as uniformly and as loosely as possible. Packing the container uniformly and loosely results in the creation of a complex network of interconnected flow space through which the invading gaseous mixture can tortuously wind itself. Uniform packing maximizes contact between the polysaccharide and the ozone by minimizing the possibility of undesired channeling through the polysaccharide by the gaseous mixture. Such channeling by the gaseous mixture would leave behine pockets of untreated polysaccharide. In packing the container uniformly, comminuted material of the same of similar size preferably should be used. This aids in preventing gravimetric sedimentation with attendant channeling effects. Loose packing of the container works in conjunction with uniform packing, and with comminuting the polysaccharide, because it similarly allows the greatest amount of surface area to be open to contact with an invading gaseous mixture.

It the polysaccharide has been packed too unevenly of tightly, it can be fluffed up by mechanical means, or by a blast of air if it is also too wet, or by a blast of wet steam if it is also too dry. It may also be maintained as a fluidized bed, using air of other gas as the fluids.

After the polysaccharide has been placed in the container, a gas comprising ozone is introduced into the container. The gas may, for example, be introduced into the bottom of a column or similar container, and passed upward through the polysaccharide. The gas may also be injected into the top of a container and be passed down through the polysaccharide. The gas could also be injected into a rotating-type or tumbling-type container, or into any other container designed to effect complete contact of a gas with comminuted solids. However, in whatever container arrangement selected, means should preferably be provided for circulating the spent gaseous mixture by collecting it after treatment, rejuvenating it and injecting it back into the treatment system for additional utilization. A closed, circulating system is especially desirable in a continuous treating arrangement, but could also be utilized in batch treating by using a bypass which would circulate the gas in the system around the treatment container, while the next batch is being prepared. The advantages of such a closed, circulating system is that it minimizes the boosting required to increase the ozone concentration in the gaseous mixture to the desired level for treatment of the polysaccharide.

The ozone which is used for treating the polysaccharide will generally comprise from about 2 per cent to about 10 per cent by volume of the gaseous mixture used to contact the polysaccharide and such a gaseous mixture may be produced by using commercially available corona discharge equipment. Oxygen or air will generally be the other major constituent of the gaseous mixture, but other gases may be included, for example, if contemporaneous treatment of the polysaccharide by these is desired, For example, if coloring, bleaching or fumigation of the polysaccharide is sought, then gases to accomplish such objectives may be used in conjunction with the ozone-containing gaseous mixture of this invention. The desired level of ozone utilized in this invention may be produced by standard corona discharge equipment acting upon a flowing stream of air or oxygen. Such equipment is described in the KirkOthmer Encyclopedia of Chemical Technology (Ed.2) Vol. 14, pp 410–432.

The temperature at which the ozone treatment of the polysaccharide is carried out will generally be between about 0°0 C. and about 90° C. Preferably, the temperature is from about 10° to 40° C. If the temperature is lower than about 0° C., the rate of interaction of ozone with the polysaccharide becomes unacceptably slow. If the temperature is higher than about 90° C., the moisture concentration would decrease, dust and other fine particles would increase and other forms of degradation of the polysaccharide could also occur.

The time of contact between the polysaccharide and the treating ozone is a function of the specific polysaccharide being treated, its moisture content, the injection rate of the gaseous mixture, the concentration of ozone, the extent of chemical transformation sought, and other parameters set by the materials and treating system involved. One test which may be used to determine this time is to measure the period necessary for a certain amount of carboxyl group to be produced in the ozone-treated polysaccharide. According to this criterion, the requisite time of contact between the polysaccharide and ozone is sufficiently long when at least 0.2 milliequivalent of carboxyl groups per gram of ozone-treated polysaccharide is produced, but better results are obtained when the level of carboxyl group is between about 0.5 milliequivalent per gram and 1.8 milliequivalents per gram or as high as 2.0 milliequivalents per gram. The amount of carboxyl groups produced may be determined by the titration method of Unruh and Kenyon (J. Am. Chem. Soc. 64, 127 (1942)), which involves treatment of the sample with a solution of calcium acetate, followed by titration of the liberated acetic acid.

The time of contact between the ozone and the polysaccharide may also be determined by measuring the viscosity of liquids containing samples of the polysaccharide being treated. According to this method, the reaction time with ozone is sufficiently long when a reduction in molecular weight is produced such that an aqueous solution of the polysaccharide after ozone treatment has a viscosity at least 30 percent less than the viscosity of a solution containing an equal concentration of the untreated polysaccharide. Viscosities may be determined in this manner by using a Brookfield viscometer which provides viscosity values in centipoises ("Synchron-Lectric" Viscosimeter, Brookfield Engineering Laboratories, Stoughton, Mass.) In the case of a polysaccharide initially insoluble in water because of a high molecular weight, an alternative time can be determined when the extent of ozone treatment is at least sufficient to render the material soluble in water. However, general experience has shown that for the parameters involved with this invention, favorable results are obtained when the time of contact is between about 20 mins. to 3 hrs.

After the polysaccharide has been treated with ozone, it may be removed from the treatment container and thoroughly mixed into an aqueous liquid. The resulting composition, which may be a solution or dispersion, should have a total solids content of from about 2 percent to about 40 percent by weight and preferably from about 5 percent to about 20 percent by weight. The aqueous liquid containing the ozone-treated polysaccharide may contain various additional ingredients useful for improving the physical character of the film, or the performance of the resultant product as a smoking material. For example, it may include alkaline earth metal compounds or salts, preferably in the form of magnesium or calcium carbonate, but may be an inorganic compound such as an oxide, hydroxide, chloride or phosphate of calcium and/or magnesium, for example, water-insoluble minerals, such as calcium and/or magnesium orthophosphates, pyrophosphate, polyphosphates, hydroxy apatites and the like. An advantageous mineral ingredient for applying controlled amounts of calcium is precipitated tricalcium phosphate (NF grade). The alkaline earth metal compound may also be a salt of an organic acid, such as a calcium or magnesium citrate, lactate, maleate or the like. Sodium or potassium salts of these organic acids may also be used as burn additives in addition to the alkaline earth metal salts of such acids. The alkaline earth metal compound, either as a single compound or as a mixture of such compounds, may be employed in an amount corresponding to from 0 to 60 parts (by weight) per 100 parts of natural polysaccharide and is preferably employed in an amount corresponding to from 8 to 40 parts (by weight) per 100 parts of the polysaccharide.

The aqueous liquid may also include a plasticizer. The plasticizer is employed to provide the desired processing characteristics for the overall composition and its use depends on the particular film-forming ingredients employed. Suitable plasticizers include certain tobacco extracts, obtained by leaching tobacco parts with a suitable solvent such as water. Other plasticizing agents include the monobasic, dibasic and tribasic acids, for example, lactic, malic, tartaric, and citric. Additional plasticizers include butylene glycols, sorbitol, sorbitan, sucrose, oligosaccharides, triglyceride fats and oils, long chain fatty alcohols, linear paraffins, normal paraffins, paraffin waxes, beeswax, candelilla wax, carnauba wax and sugar cane wax. When one of these materials is employed, or a combination of these materials is employed, it has been found that the subjective evaluation of the taste and aroma of the smoke resulting from products incorporating the same have been favorable. The plasticizer, when employed, will generally be employed in an amount corresponding to from minute amounts to about 5 parts (by weight) per 100 parts of the film-forming ingredient. Humectants, such as glycerine, monoacetyl glycerol, triethylene glycol, propylene glycol, invert sugar and corn syrup, are preferably employed in the composition, in an amount of from about 2 to about 40 parts per 100 parts of film-forming ingredient. However, the total amount of plasticizer and/or humectant employed should not exceed 50 parts (by weight) per 100 parts of the film-forming natural polysaccharide.

Other materials which may be included are extracts from tobacco leaf, and other flavorants which have characteristics to make a desirable smoke. Such flavorants include, for example, licorice, deer tongue, principal oils of rum, chocolate, fruit essence and the like.

After the polysaccharide has been placed in the aqueous liquid, the solution or dispersion may then be deposited as a thin layer on a conventional drying surface.

The layer may then be heated to evaporate the water, thus leaving a uniform, flexible, solid film. In order to withstand further processing, the film should preferably have a tensile or breaking strength preferably between about 0.2 kilogram per inch and 1.0 kilogram per inch, as measured on an Instron Tensile Tester using a one-inch wide sample strip of film. The use of cast film as a base for the present invention provides the more preferred mode of operation since the film can be more readily processed and, thus, more readily converted into a product which closely resembles the natural tobacco leaf product. However, the present tobacco substituted may also be made by other methods, including extrusion in fibrous or sheet form or in other shapes, all of which can be cut or comminuted into the desired size for incorporation into a tobacco substitute.

After the film has been formed, it may be cut to form elongated, ribbon-like shreds for filler material. If the tensile strength of the shreds is below 0.1 kilogram per inch, excessive breakage occurs during the fabrication process. If the tensile strength is above about 2.0 kilograms per inch, the material will not process properly on conventional tobacco manufacturing equipment.

The film can also be cut to form thin, paper-like wrappers for tobacco products such as cigarettes, cigars, cigarillos and other tobacco articles.

The foregoing discussion has been a description of a polysaccharide being treated by ozone while initially in a comminuted solid form. The polysaccharide may also be treated with ozone while initially dissolved or dispersed in a liquid such as water. In such a process, the polysaccharide is selected, comminuted, placed in a solution or dispersion having a total solids content by weight of between about 4 percent and 15 percent, contacted with a gaseous mixture containing from between about 2 percent and 10 percent by weight of ozone by bubbling the gaseous mixture through the liquid or by any other means to effect contacting the polysaccharide particles with ozone, at a temperature of between about 0° C. and 50° C., for a time of contact sufficient to produce at least 0.2 milliequivalent of carboxyl group per gram of ozone-treated polysaccharide.

The polysaccharide may also be treated with ozone, under conditions similar to those set forth above, after it has been processed into a solid film and cut or comminuted for use in a smoking article. Under such circumstances, a longer time of exposure to the ozone is required to achieve the desired results.

The above discussion has also been concerned primarily with ozone treatment of the polysaccharide, but additional treatments may, if desired, be incorporated into the process for fabricating a satisfying tobacco substitute. For example, the polysaccharide may also be treated with ammonia either prior to or subsequent to the ozone treatment. The ammonia is preferably employed in gaseous form in treating solid polysaccharides but may be employed in the form of aqueous ammonium hydroxide solution when formulating casting mixtures preparatory to the formation of sheet structures. The presence of ammonia improves the water solubility of the ozone-treated polysaccharide and improves the subjectively perceived smoking characteristics.

Comminuted polysaccharide, following ozone treatment, may also be heat treated at temperatures of 40°–110° C. for periods of time ranging from about 10 minutes to five hours. The heat treatment accelerates oxidative and hydrolytic reactions initiated by the ozone treatment, and produces further reduction in molecular weight of the treated polysaccharide with attendant increase in solubility and improvement in smoking quality.

The invention may be illustrated by the following examples:

EXAMPLE 1

Granular lemon albedo material, obtained from the Sunkist Growers, Inc., Ontario, California, was utilized in this example. The lemon albedo, which contained pectin polysaccharide material useful in accordance with this invention, was obtained from the peels of lemons by removing the outer peripheral skin and subjecting the remaining material to a solvent extraction process to remove oleophilic oils.

A glass cylinder having an inside diameter of 2 inches and a base consisting of a porous glass disc was filled with 50 grams of the lemon albedo, forming a column in the cylinder 13 inches high. The ozone was prepared using a W. R. Grace Ozone Generator, Model LG-2-Ll, operating on an oxygen feed of 10 standard cubic feet per hour. The ozone was flowed through the column of lemon albedo at room temperature (about 24° C.) and ambient pressure for a period of 30 minutes. During this time, approximately 145 liters of gas containing 6 percent ozone was passed in contact with the lemon albedo. The column was then purged with oxygen for another 30 minutes to remove any trace of ozone. Ten grams of ozone-treated lemon albedo and 1.6 grams of citric acid were stirred into 200 cubic centimeters of hot water and acidified to pH 1.5 using concentrated hydrochloric acid. The mixture was heated and stirred at 90° C. for 15 minutes. The mixture was then cooled and neutralized with concentrated ammonium hydroxide, and the following ingredients were added, with continued stirring:

3.0 grams reprecipitated calcium carbonate
3.0 grams corn syrup
1.2 grams glycerine
0.8 gram potassium citrate
0.2 gram potassium sorbate The viscosity of the mixture at a 5.2 percent by weight solids concentration, at room temperature and ambient pressure, was found to be 5,300 centipoises using a Brookfield viscometer, such as model RVT. The comparable viscosity of a control sample prepared in an identical manner, but using lemon albedo which had not been subjected to the ozone treatment, was found to be 9,500 centipoises.

The solutions of ozone treated and untreated lemon albedo were then cast on stainless steel plates using a doctor blade having a 25/1000 inch gap and dried to form films. The film made from the ozone-treated lemon albedo had a tensile strength of 0.25 kilogram per inch, while the control sample film had a tensile strength of 0.50 kilogram per inch. The two films were then shredded using a Jet 1232 Shredmaster to yield shreds averaging ½ inch to 1 inch long, 1/30 inch wide and 3/1000 inch to 5/1000 inch thick. Handmade cigarettes were prepared and the character of the smoke from the ozone-treated lemon albedo was compared to that of the untreated control sample. The smoke from cigarettes made from the ozone-treated material was adjudged by a panel of expert smokers to be more pleasing and satisfying than the smoke from the cigarettes made from the untreated material.

EXAMPLE 2

The following materials were mixed with water to provide a slurry having a solids content of 14.4 percent:

33.0 parts (by weight) calcium carbonate
22.0 parts (by weight) H-CMC (7HS FA-Hercules) which is carboxymethyl cellulose in acidic form, having a degree of substitution of 0.7, and having a molecular weight such that a 1 percent solution of the sodium salt form will have a viscosity between 1300 and 2000
13.0 parts (by weight) magnesium hydroxide
11.0 parts (by weight) spent hops which have been serially extracted with hexane and ethanol, and which contain 12 percent pectin and 21 percent hemicellulose
5.5 parts (by weight) cocoa
5.5 parts (by weight) glycerine
3.3 parts (by weight) alpha cellulose
3.3 parts (by weight) potassium hydroxide
2.2 parts (by weight) urea
1.2 parts (by weight) bixin color The viscosity of the slurry at 25° C. was found to be 38,000 centipoises. The slurry was placed in a cylindrical vessel, 2 feet high with an inside diameter of 3 inches and treated with ozone by bubbling a mixture of 8 percent by volume of ozone and 92 percent by volume of oxygen through the slurry at 60° C. for 5 hours. During this time, approximately 50 cubic feet of the ozone mixture came in contact with the slurry. At the end of this treatment, the viscosity of the slurry was found to be 16,000 centipoises.

The treated slurry was employed for the production of film material by a similar method to that described in Example 1. The film had a thickness of 4/1000 inch and a tensile strength of 0.4 kilogram per inch. The film was shredded and blended with an equal portion of regular tobacco and the mixture was used for the manufacture of cigarettes. The smoking quality of these cigarettes was compared by a panel of expert smokers with that of cigarettes made in an identical manner, but with untreated material. It was the general opinion of the panel that the ozone-treated sample had a milder, more pleasing smoke.

EXAMPLE 3

One hundred grams of amylose, a corn starch derivative distributed by the American Maize Products Co. of New York City was formed into a slurry with water, and the slurry was converted into a film by the method of Example 1. The film had a thickness of 3/1000 inch and a tensile strength of 0.3 kilogram per inch. The film was comminuted into shreds having an average length of 1 inch and width of 1/10 inch.

About 50 grams of the shredded film was placed in a jacketed column maintained at 30° C. and was treated with an ozone-containing gas which had been moisturized by being bubbled through water maintained at 35° C. The gas contained 3.5 percent by volume of ozone. The treatment with ozone was continued for 5 hours, at which time the shreds were found by titration to have 0.7 milliequivalent of carboxyl group per gram of dry material. Approximately 50 cubic feet of the ozone mixture was passed in contact with the film over the 5 hour period. The resulting material was blended with an equal portion of tobacco. The blend was used to make cigarettes which were then smoked by a panel of experts and compared to cigarettes made in an identical manner, but with untreated material. The panel adjudged the ozone-treated material to provide a milder, more pleasing smoke.

EXAMPLE 4

Fifty grams of amylopectin ("Ramalin," a product of Stein, Hall & Co.) was mixed with water at 15° C. to form a slurry, and an ozone-containing gas (3.5 percent volume of ozone) was bubbled through the slurry for six hours. Approximately 60 cu. ft. of the ozone mixture passed in contact with the slurry maintained at a temperature of 35° C. The treated starch was found to have 0.8 milliequivalent of carboxyl group per gram of dry starch. The treated slurry was then converted to a film by the method of Example 1, which yielded a film with a thickness of 4.5/1000 inch and a tensile strength of 0.5 kilogram per inch. The shredded film material was blended with regular shredded tobacco at a 40:60 ratio and the mixture was used for the manufacture of cigarettes. The smoking quality of the cigarettes was compared by a panel of expert smokers with cigarettes made in an identical manner, but with untreated material. It was the majority opinion of the panel that the ozone-treated sample gave a milder, more pleasing smoke.

EXAMPLE 5

A sample of 50 grams of lemon albedo, similar to that employed in Example 1, with a 10.5 percent moisture content was commingled with 39.5 grams of water in a plastic bag and allowed to equilibrate for 24 hours. The resulting moisture content was found to be 50 percent by weight, based on the total weight of the moisture-containing albedo. The material was then placed in a column having an inner diameter of 42 millimeters and a base consisting of a glass disk. The height of the sample in the column was 190 millimeters. A mixture of ozone and oxygen, containing 8 percent by volume of ozone, produced in a corona discharge ozone generator, was flowed at a rate of 10 cu. ft./min., first through a water bubbler, then through the sample. An exotherm, accompanied by bleaching, started and gradually rose to the top of the column. After one hour the ozone generator was shut off. During the hour about 600 cubic feet of the ozone mixture were passed through the column. Dry air was then passed through the column for 3 hours.

The sample thus prepared was converted into a casting slurry by a method similar to that employed in Example 1. The slurry was found to have a viscosity of 1,500 centipoises, at a solids concentration of 6.7 percent. A slurry prepared from a control sample using untreated material was found to have a viscosity of 11,400 centipoises at the same solids concentration. Both the ozone-treated material and the control sample were shredded and used for the manufacture of cigarettes. The ozone-treated material was found by test smokers to provide a milder smoke than the control sample.

The product of the present invention, as shown by the examples presented above, represents an important improvement in the art of substitute smoking materials. It may be employed as a wrapper for a smoking article. It may be employed as a filler alone, in a smoking article or it may be combined in any proportion with tobacco, eiter natural or reconstituted or with one or more other tobacco substitutes. It is particularly adapted for use without the addition of any other substance, since it can be made in such a manner that it provides some of the desirable properties of natural tobacco.

The process of the present invention as shown by the examples presented above also represents an important improvement in processes for producing substitute smoking materials. This process offers an effective, simple and economical method for manufacturing a substitute for tobacco which is both pleasing and satisfying.

Various changes in the specifically described product and process of this invention will be evident to those skilled in the art. The particular disclosure herein is, thus, intended in an illustrative and not in a limiting sense. The true spirit and scope of the invention are defined in the claims that follow.

What is claimed is:

1. A process for preparing a tobacco substitute smoking material comprising contacting a film-forming carbohydrate material with ozone such that at least 0.2 milliequivalent of carboxyl groups, per gram of ozone-treated carbohydrate material, is produced in the treated carbohydrate material and the film-forming carbohydrate material is reduced in molecular weight to the extent that an aqueous solution or dispersion of the carbohydrate after ozone treatment has a viscosity at least 30% less than the viscosity of an aqueous solution or dispersion containing an eqaul concentration of the carbohydrate prior to the ozone treatment or to the extent that the carbohydrate, initially insoluble in water, is at least rendered soluble or dispersible in water after ozone treatment.

2. The process of claim 1, wherein said carbohydrate is contacted with said ozone under conditions such that said ozone is passed as a gaseous stream through a bed of said carbohydrate in particulate form.

3. The process of claim 2, wherein said gaseous stream comprises from about 2 percent to about 10 percent by volume of ozone and from about 90 to about 98 percent by volume of a gas selected from the group consisting of air and oxygen.

4. The process of claim 1, wherein the ozone treatment is at a temperature of 0° - 90° C.

5. The process of claim 1, wherein an aqueous solution or dispersion of said film-forming carbohydrate is cast into a solid film and then subjected to the ozone treatment.

6. A process for making a tobacco substitute smoking material comprising the steps of:

a. contacting a film-forming carbohydrate with ozone such that at least 0.2 milliequivalent of carboxyl groups, per gram of ozone — treated carbohydrate material, is produced in the treated carbohydrate material and the film-forming carbohydrate material is reduced in molecular weight to the extent that an aqueous solution or dispersion of the carbohydrate after ozone treatment has a viscosity at least 30% less than the viscosity of an aqueous solution or dispersion containing an equal concentration of the carbohydrate prior to the ozone treatment or to the extent that the carbohydrate, initially insoluble in water, is at least rendered soluble or dispersible in water ofter ozone treatment b. forming a casting fluid by dissolving or dispersing the ozone-treated carbohydrate in an aqueous liquid c. casting the solution or aqueous dispersion to form a thin layer d. heating and drying the layer to form a thin film, and e. comminuting the film into a form suitable as a tobacco substitute.

7. The process of claim 6, wherein said film-forming carbohydrate is a polysaccharide.

8. The process of claim 7, wherein said polysaccharide is a pectin.

9. The process of claim 8, comprising the steps of:

a. contacting lemon albedo with gaseous ozone at room temperature and ambient pressure to the extent specified b. dissolving or dispersing the ozone treated albedo in an aqueous solution together with flavorants, burn additives, and humectants c. casting the solution or dispersion into a thin layer d. heating and drying the layer into a film, and e. comminuting the film into a form suitable as a tobacco substitute.

* * * * *

UNITED STATES PATENT AND TRADEMARK OFFICE

CERTIFICATE OF CORRECTION

PATENT NO. : 4,034,764

DATED : July 12, 1977

INVENTOR(S) : Norman B. Rainer, et al

It is certified that error appears in the above-identified patent and that said Letters Patent are hereby corrected as shown below:

Column 1, line 31, "coo" should read --cco--. Column 2, line 36, "of" should read --or--. Column 4, line 49, "pecting" should read --pectin--. Column 5, line 50, "shaped" should read --shape--. Column 5, line 66, "behine" should read --behind--. Column 5, line 68, "of" should read --or--. Column 6, line 7, "It" should read -- If--. Column 6, line 45, "these is" should read --these gases is--. Column 6, line 57, "0°0C." should read --0°C--. Column 13, line 5, "eqaul" should read --equal--. Column 14, line 11, "solution or aqueous" should read --aqueous solution or--.

Signed and Sealed this

Ninth Day of May 1978

[SEAL]

Attest:

RUTH C. MASON
Attesting Officer

LUTRELLE F. PARKER
Acting Commissioner of Patents and Trademarks